US006233500B1

(12) United States Patent
Malas et al.

(10) Patent No.: US 6,233,500 B1
(45) Date of Patent: May 15, 2001

(54) OPTIMIZATION AND CONTROL OF MICROSTRUCTURE DEVELOPMENT DURING HOT METAL WORKING

(75) Inventors: James C. Malas, Bellbrook; W. Garth Frazier; Enrique A. Medina, both of Xenia; Venkat Seetharaman, Beavercreek; S. Venugopal, Fairborn; R. Dennis Irwin, Athens; William M. Mullins, Dayton; Steven C. Medeiros, Fairborn; Anil Chaudhary, Centerville; Raghavan Srinivasan, Beavercreek, all of OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 09/053,898

(22) Filed: Apr. 2, 1998

Related U.S. Application Data

(60) Provisional application No. 60/050,253, filed on Jun. 19, 1997.

(51) Int. Cl.[7] ..... B29F 3/24

(52) U.S. Cl. ..... 700/204; 419/28; 73/863; 72/364

(58) Field of Search ..... 700/23, 117, 118, 700/145–147, 173, 207–211; 75/245; 148/156, 160, 164; 72/364, 377

(56) References Cited

U.S. PATENT DOCUMENTS

| | | | | |
|---|---|---|---|---|
| 4,617,817 | | 10/1986 | Gegel et al. | 72/364 |
| 4,762,679 | | 8/1988 | Gegel et al. | 419/28 |
| 4,923,513 | * | 5/1990 | Ducheyne et al. | 75/245 |
| 5,958,158 | * | 9/1999 | Kron et al. | 148/598 |
| 6,010,584 | * | 1/2000 | Fonda et al. | 148/563 |

OTHER PUBLICATIONS

"*Optimization of Microstructure Development: Application to Hot Metal Extrusion*," J.C. Malas et al, Proceedings of the 1996 Engineering Systems Design and Analysis Conference, PD–vol. 75 Engineering Systems and Analysis, vol. 3 (ASME 1996).

"*Optimization of Microstructure Development: Application to Hot Metal Extrusion*," E.A. Medina et al, Journal of Materials Engineering and Performance, vol. 5:6 (Dec. 1996) pp 743–752.

"*Optimization of Microstructure During Deformation Processing Using Control Theory Principles*," S. Venugopal et al, Scripta Materialia, vol. 36:3, 347–353 (Feb. 1, 1997).

"*Optimization of Microstructure Development During Hot Working Using Control Theory*," J.C. Malas et al, Metallurgical and Materials Transactions, vol. 29A:9, 1921–1930 (Sep. 1997).

"*Application of Control Theory Principles to the Optimization of Grain Size During Hot Extrusion*," W.G. Frazier et al, Materials Science and Technology, (submitted for publication).

(List continued on next page.)

*Primary Examiner*—William Grant
*Assistant Examiner*—Kidest Bahta
(74) *Attorney, Agent, or Firm*—Bobby D. Scearce; Thomas L. Kundert

(57) ABSTRACT

A method for predicting process parameters for optimization and control of microstructure in metal and alloy products of hot working fabrication processes is described. The method uses state-space material behavior models and hot deformation process models for calculating optimal strain, strain rate and temperature trajectories for processing the material. Using the optimal trajectories and appropriate optimality criteria, suitable process parameters such as ram velocity and die profile for processing the material are determined to achieve prescribed strain, strain rate and temperature trajectories.

6 Claims, 12 Drawing Sheets

OTHER PUBLICATIONS

"*Strength and Structure Under Hot–Working Conditions*," Jonas et al, Metall Rev, 14:1, 1–24 (1969).
C.M. Sellars, Philos Trans Roy Soc, 288, 147 (1978).
"*Recovery and Recrystallization During High Temperature Deformation*," H.J. McQueen et al, in Treatise On Materials Science and Technology, vol. 6, Plastic Deformation of Materials, Academic Press, New York, (1975) pp 393–493.
"*Dynamic Changes That Occur During Hot Working and Their Significance Regarding Microstructural Development and Hot Workability*," W. Roberts, in Deformation, Processing and Structure, G. Krauss, Ed, ASM International, Metals Park OH (1984) pp 109–84.
*Process Control in Steel Industry*, vol. 2, W. Roberts, Mefos, Sweden (1986) pp 551–577).
*Methodology For Design And Control Of Thermomechanical Processes*, J.C. Malas, Ph.D dissertation, Ohio University, Athens OH (1991).
"*Using Material Behavior Models To Develop Process Control Strategies*," J.C. Malas et al, J Metals, 44:6, 8–13 (1992).
"*A Compendium of Processing Maps*," Y.V.R.K. Prasad et al, in Hot Working Guide, ASM International, Materials Park OH (1997).
"*The Plasticity and Creep of Metals and Ceramics*," H.J. Frost et al in Deformation Mechanism Maps, Pergamon Press, Oxford (1982).
"*Development of a Processing for Use in Warm–Forming and Hot–Froming Processes*," R. Raj, Metall Trans A, 12A, 1089 (1981).
*Optimal Control Theory: An Introduction*, D.E. Kirk, Prentice–Hall Inc., New Jersey, 1970, pp 29–46, 184–309).
"*Prediction of Microstructural Changes and Mechanical Properties in Hot Strip Rolling*," H. Yada, Proc. Int. Symp. Accelerated Cooling of Rolled Steels, Conf. of Metallurgists, CIM, Winnipeg MB, Canada, Aug. 24–26, eds G.E. Ruddle and A.F. Crawley, Pergamon Press, Canada, pp 105–20.
*Antares Software User Manual*, UES, Inc, Dayton OH (1995)).
*High Temperature Micro–Morphological Stability of the* ($\alpha_2$+$\gamma$) *Lamellar Structure in Titanium Aluminides*, S. Guillard, PhD Thesis, Clemson Univ (1994)).

* cited by examiner

OPTIMIZATION AND CONTROL OF MICROSTRUCTURE DEVELOPMENT DURING HOT METAL WORKING

CROSS-REFERENCE TO RELATED APPLICATION

This application claims priority of the filing date of Provisional Application Serial No. 60/050,253 filed Jun. 19, 1997, the entire contents of which application are incorporated by reference herein.

RIGHTS OF THE GOVERNMENT

The invention described herein may be manufactured and used by or for the Government of the United States for all governmental purposes without the payment of any royalty.

BACKGROUND OF THE INVENTION

The present invention relates generally to systems and methods for hot working metals and alloys, and more particularly to a method for selecting process parameters in the design, optimization and control of microstructure in metals and alloys during hot working fabrication processes.

Control of microstructure during hot working of metals and alloys according to conventional methods is done by expensive trial and error techniques because no systematic approach exists for the optimization and control of microstructure in the finished product following hot working.

The invention solves or substantially reduces in critical importance problems with existing hot working processes by providing a method for systematic selection, optimization and control of process parameters for microstructure control in the fabrication of a hot worked metal or alloy product. The invention is characterized by two process stages. In the first stage, microstructure is optimized in the final hot worked product using the kinetics of dynamic microstructural behavior associated with the dominant mode of deformation and the intrinsic hot workability of the material, along with appropriately chosen optimality criteria, to select strain, strain-rate and temperature trajectories to achieve the desired microstructure. The trajectories depend on material selection, are independent of die geometry, and can be used in association with various hot deformation processes with similar material flow pattern. In the second stage, the process for achieving the desired product microstructure characteristics is optimized using a process simulation model to predict process parameters (such as ram velocity profiles, billet temperature and nominal preform and die geometries) which achieve the strain, strain-rate and temperature trajectories calculated in the first stage at specific regions in the workpiece. The invention may be applied to a wide range of process models, including simple slab type models and high fidelity finite element simulation models, and is useful in the optimal design and control of manufacturing processes needed for effectively reducing part cost and improving production efficiency and product quality.

It is therefore a principal object of the invention to provide an improved hot working fabrication method for metals and alloys.

It is another object of the invention to provide a method for selecting process parameters in designing, optimizing and controlling microstructure during hot deformation processes.

It is another object of the invention to provide a method for selecting process parameters for controlling microstructure in manufacturing metal or alloy parts of substantially any size or shape.

These and other objects of the invention will become apparent as a detailed description of representative embodiments proceeds.

SUMMARY OF THE INVENTION

In accordance with the foregoing principles and objects of the invention, a method for predicting process parameters for optimization and control of microstructure in metal and alloy products of hot working fabrication processes is described. The method uses state-space material behavior models and hot deformation process models for calculating optimal strain, strain rate and temperature trajectories for processing the material. Using the optimal trajectories and appropriate optimality criteria, suitable process parameters such as ram velocity and die profile for processing the material are determined to achieve prescribed strain, strain rate and temperature trajectories.

DESCRIPTION OF THE DRAWINGS

The invention will be more clearly understood from the following detailed description of representative embodiments thereof read in conjunction with the accompanying drawings wherein.

DETAILED DESCRIPTION OF THE INVENTION

Background information, including theoretical developments and discussions of the underlying principles of operation of the invention and test results on experiments performed to verify methodology taught by the invention may be found by reference to the papers, "Optimization of Microstructure Development: Application to Hot Metal Extrusion," J. C. Malas et al, *Proceedings Of The* 1996 *Engineering Systems Design And Analysis Conference,* Vol 3 (ASME PD Vol 75 (1996)); "Optimization of Microstructure Development: Application to Hot Metal Extrusion," E. A. Medina et al, *Journal Of Materials Engineering And Performance,* Vol 5:6 (December 1996) pp 743–752; "Optimization of Microstructure during Deformation Processing Using Control Theory Principles," S. Venugopal et al, *Scripta MATERIALIA,* Vol 36:3 (February 1997) pp 347–353; "Optimization of Microstructure Development: During Hot Working Using Control Theory," J. C. Malas et al, *Metallurgical And Materials Transactions,* (accepted for publication late 1997); and "Application of Control Theory Principles to the Optimization of Grain Size During Hot Extrusion," W. G. Frazier et al, *Materials Science And Technology,* (accepted for publication late 1997); the entire teachings of which are incorporated by reference herein.

Figure 1:
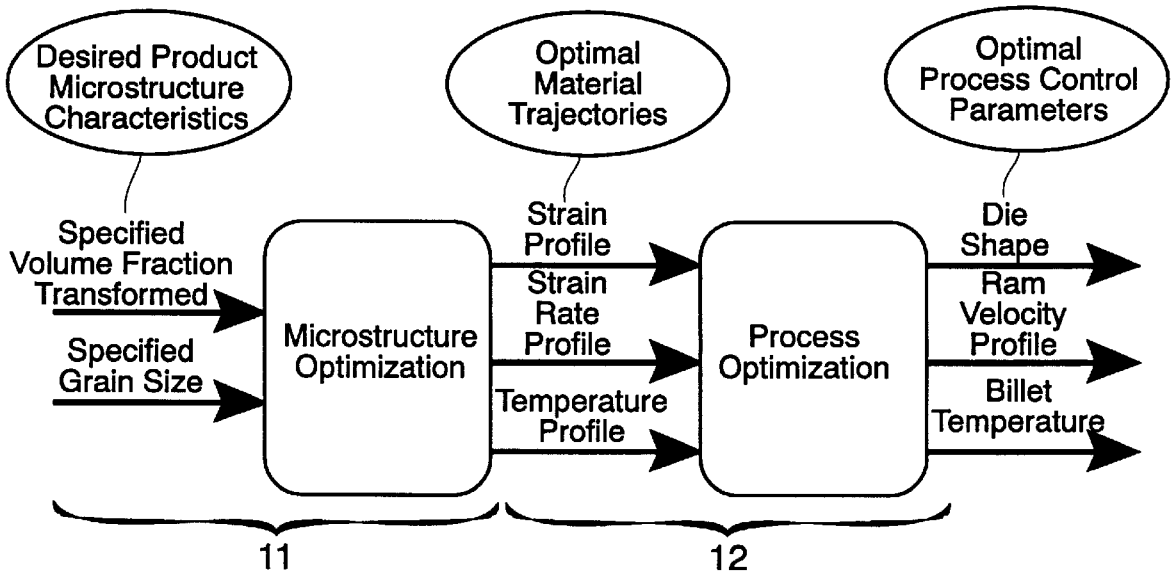
FIG. 1 is a schematic block diagram of the two-stage microstructure optimization and process optimization method of the invention.

Referring now to the drawings, FIG. 1 is a schematic block diagram detailing the two-stage microstructure optimization method of the invention. In Microstructure Optimization stage 11, optimal material trajectories for true plastic strain $\epsilon(t)$, effective strain rate $\dot{\epsilon}(t)$, and temperature T(t), are selected for achieving enhanced workability and prescribed microstructure in the material. The optimal trajectories are then used in Process Optimization stage 12 to select process parameters, such as, for the extrusion process, ram velocity $V_{ram}(t)$, initial workpiece (billet) temperature $T_{billet}$, and die shape, in order to achieve thermomechanical conditions selected in stage 11 for selected regions of the deforming workpiece.

In stage 11, material behavior models that describe kinetics of metallurgical mechanisms such as dynamic recovery, dynamic recrystallization and grain growth during hot working are required for analysis and optimization of material system responses. Relationships for describing particular microstructural processes have been developed and reported for conventional materials such as aluminum, copper, iron, nickel and their dilute alloys (see, e.g., "Strength and Structure Under Hot-Working conditions," J. J. Jonas et al, *Metall Rev,* 14:1, 1–24 (1969); "Recrystallization of Metals During Hot Deformation," C. M. Sellars, *Philos Trans Roy Soc,* 288, 147 (1978); H. J. McQueen et al, "Treatise on Materials Science and Technology," *Plastic Deformation of Materials,* Vol 6, Academic Press, New York, (1975) pp 393–493; "Dynamic Changes That Occur During Hot Working and Their Significance Regarding Microstructural Development and Hot Workability," W. Roberts, in *Deformation, Processing And Structure,* G. Krauss, Ed, ASM International, Metals Park Ohio (1984) pp 109–84; W. Roberts, *Process Control In Steel Industry,* Vol 2, Mefos, Sweden (1986) pp 551–577). Within specific temperature and strain rate ranges, models may be developed for microstructural changes in specialty alloys such as super alloys, intermetallics, ordered alloys and metal matrix composites (see e.g. J. C. Malas, *Methodology For Design And Control Of Thermomechanical Processes,* PhD dissertation, Ohio Univ, Athens Ohio (1991); "Using Material Behavior Models To Develop Process Control Strategies," J. C. Malas et al, *J Metals,* 44:6, 8–13 (1992)).

In accordance with the teachings of the invention and considering the process of dynamic recrystallization in a material, the state of the microstructure may be defined by grain size d, volume fraction recrystallized $\chi$, accumulated strain $\epsilon$ and workpiece temperature T. These variables change with time during deformation and the changes may be defined by the state-space model:

$$\begin{bmatrix} \dot{d} \\ \dot{\chi} \\ \dot{\varepsilon} \\ \dot{T} \end{bmatrix} = \begin{bmatrix} f_1(T, \dot{\varepsilon}, d) \\ f_2(T, \dot{\varepsilon}, d, \dot{\chi}) \\ u \\ \eta\sigma\dot{\varepsilon}/(\rho C_p) \end{bmatrix} \tag{1}$$

where $f_1$ and $f_2$ are obtained from models for microstructural evolution, u is a control variable, $\eta$ is the fraction of mechanical work converted to heat, $\sigma$ is the flow stress, $\rho$ is the density, and $C_p$ is the specific heat and $\rho C_p$ is the heat capacity of the material. The evolution of strain is directly related to u, the strain rate, which is a system input.

In addition to dynamic system models, formulation of optimum control parameters requires a statement of physical constraints and the specification of an optimality criteria. Limiting process conditions for acceptable hot workability are important material behavior constraints in stage 11 of the invention. Existing methods for identifying acceptable strain rate and temperature ranges for hot working metals and alloys include flow stability analysis (see Malas dissertation, supra), processing maps (see Y. Prasad et al, in *Hot Working Guide,* ASM International, Materials Park Ohio (1997)), deformation maps (see H. J. Frost et al in *Deformation Mechanism Maps; The Plasticity And Creep Of Metals and Ceramics,* Pergamon Press, Oxford (1982)), and damage nucleation maps (see R. Raj, *Metall Trans A,* 12A, 1089 (1981)), and are referred to generally as material processing maps. Within the acceptable processing regime, a particular thermomechanical trajectory is determined using the prescribed optimality criterion, such as production of specified hot worked microstructural characteristics.

The generalized optimality criterion J may be formulated as a function, $$J = h(x(t_f)) + \int_0^{t_f} g(x(t), u(t))\,dt \tag{2}$$

which is minimized with respect to u(t) while satisfying the system state equation $$\dot{x}(t)=f(x(t),u(t))\quad x(0)=x_0 \tag{3}$$

where t is time, x(t) is a vector of state variables, u is a system input or control variable, $t_f$ is the duration of the process, h is cost associated with violating the desired final stage (terminal penalty function), g is the integrand of the cost associated with the trajectories followed by the state variables and the input, f is a vector function describing the process dynamics and $x_0$ is the initial state vector. The foregoing formulation presupposes that the material process system to be optimized can be modeled by first-order, time-invariant ordinary differential equations (state equations), and that the final states are specified as part of optimality criterion J.

Optimality criteria for control of material behavior during hot metal deformation include producing specified microstructural features and/or gradient of microstructure within a specified variance on a repeatable basis. Optimality criteria can usually be formulated as functions to be minimized and are often lumped together into a single scalar optimality criterion (objective function) J in the form, $$J=J_1^F+J_2^F+\ldots+J_{N_F}^F+J_1^T+J_2^T+\ldots+J_{N_T}^T \tag{4}$$

where superscripts F and T denote requirements on desired final states and trajectories, respectively. In case it is desired that microstructure feature x achieve value $x_d$ at termination of the deformation process, the corresponding term in J may take the form, $$J_i^F=\beta_i\, x(t_f)-x_d^2 \tag{5}$$

where $\beta_i$ is a weighting factor for terms of a generic cost function, which may also include certain fixed process parameters and other final values for non-microstructural quantities, such as strain and temperature, in optimization calculations. The terms $J_j^T$ in the optimality criterion define requirements on desired state and control input trajectories to be followed during the forming process and have integral forms.

Table I lists examples of typical optimality criteria for microstructure development during hot metal deformation, including final value and trajectory specifications. The general formulation allows new terms to be defined according to specific needs of each end product. The terms $f_k(x, a)$ and $f_k(x, a, b)$ in Table I are penalty functions that can constrain optimized design solutions within acceptable process parameter ranges imposed by material workability or equipment limitations. These functions evaluate to virtually zero for values of x in the acceptable range and attain very high values when x is outside that range. Scalars a and b define acceptable ranges for bounded process parameters such as temperature or strain-rate.

The weight factors $\beta_i$ serve three purposes. First, they are used to scale terms in $J_i$ given in Eq (4) in order to have comparable influence in satisfying the overall optimality criterion. Second, weight factors are increased for certain terms according to their relative importance to achieve the intended material characteristics. Third, weight factors may be adjusted to avoid possible conflicts in product requirements and to obtain an optimized solution compromise.

Cost function J, which is to be minimized in order to determine $\epsilon$, $\dot{\epsilon}$ and T, can incorporate a number of physically realistic requirements. Specifically for hot metal deformation, $$J=\beta_1\left(d(t_f)-\hat{d}\right)^2+\beta_2(\chi(t_f)-\hat{\chi})^2+\int_0^{t_f}\beta_3(t)\dot{\epsilon}(t)-\dot{\epsilon}_w(t)^2+\beta_4(t)T(t)-T_w(t)^2+\beta_5(t)g_1 d(t)dt \tag{6}$$

can be formulated. In Eq (6), d is the average recrystallized grain size, $\hat{d}$ is the desired final grain size, $\hat{x}$ is the desired final volume fraction recrystallized, $\dot{\epsilon}_w$ is the nominal strain rate value for acceptable workability, $T_w$ is the nominal temperature value for acceptable workability. Penalty function $g_1$ ensures that grain size d(t) is maintained below a desired value throughout deformation.

Optimization is achieved in two steps. First, a set of necessary conditions for optimality is obtained by applying variational principles given by Kirk (ref D. E. Kirk, *Optimal Control Theory: An Introduction,* Prentice-Hall Inc., New Jersey, 1970, pp 29–46, 184–309). This formulation defines the necessary conditions for optimization as a set of constraint equations. Second, a numerical algorithm is defined for solving the equations according to the method described below.

Figure 2A:
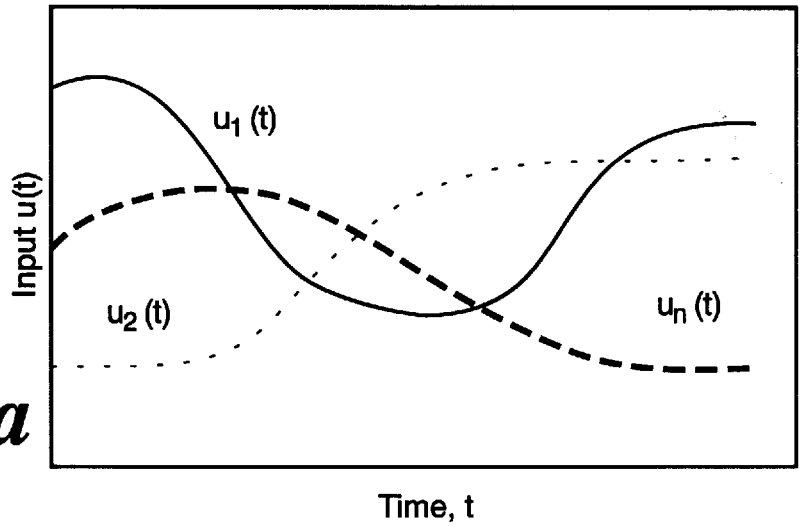
FIGS. 2*a,* 2*b* and 2*c* show a one-input, one-state optimal control example, respectively, for several possible input trajectories, corresponding state trajectories and optimality criterion values.
Figure 2B:
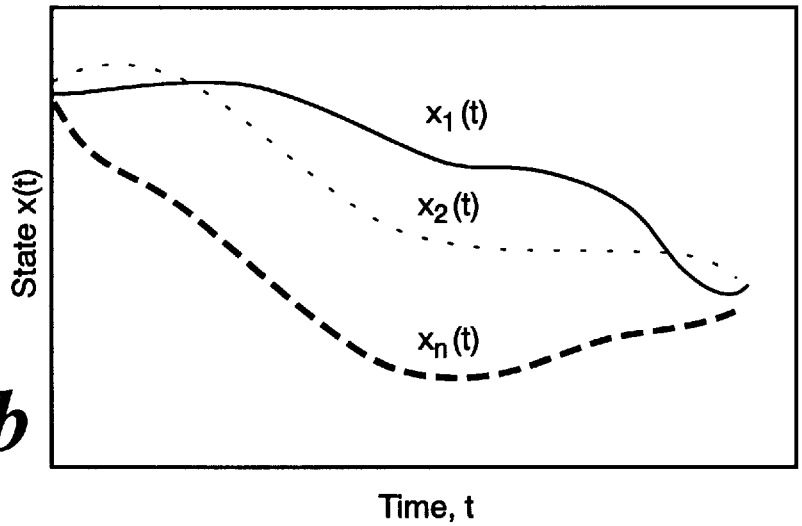
Figure 2C:
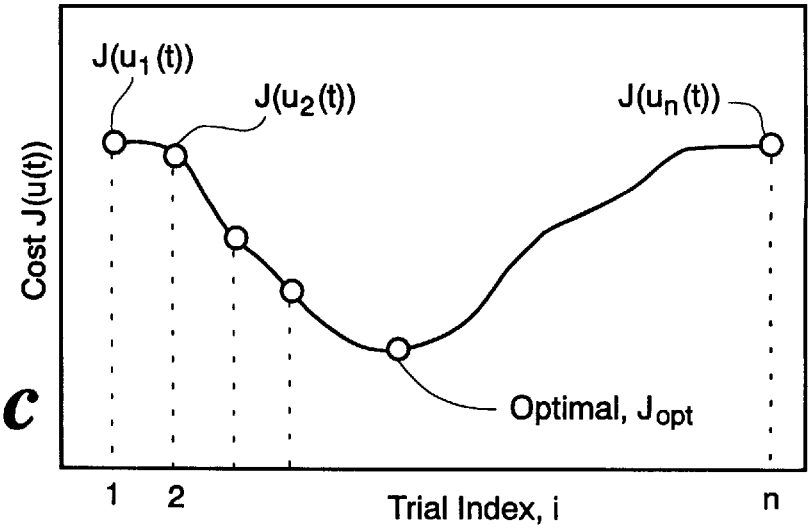

As an example of microstructure development optimization defined by Eqs (2) and (3), reference is made to FIGS. 2*a,* 2*b* and 2*c* which illustrate a one-input, one-state optimal control example respectively for several possible input trajectories, corresponding state trajectories and corresponding values of the optimality criterion. Consider that an optimality criterion of the type given by Eq (2) has been defined and that several possible input trajectories have been evaluated according to that criterion. FIG. 2*a* shows several of the infinite trajectories that the system input can follow. Corresponding trajectories of the state variable are given in FIG. 2*b*. In FIG. 2*c* values of the optimality criterion that correspond to each trial trajectory are plotted as functions of the trial index, in order to find input trajectories that, taken with the corresponding state trajectories, define the cost $J_{opt}$. Minimization of an optimality criterion implies only that the system is optimized with respect to that specific criterion, and not that the intended product characteristic is/is not achieved.

First, the original constrained minimization function is transformed to an equivalent unconstrained function by appending the microstructural evolution equations via Lagrange multipliers to the objective function to form a modified objective function. Necessary optimality conditions are then obtained by transforming the unconstrained optimization criteria to a set of constraint equations. The constraint equations are then solved using a numerical algorithm as follows.

In order to transform Eq (2) under Eq (3) constraints into a purely integral form, assume that h is a differentiable function and introduce Lagrange multipliers $p_1(t), p_2(t), \ldots, p_n(t)$, referred to as costates. It can be shown that minimizing J is equivalent to minimizing the augmented functional, $$J_a(u)=\int_0^{t_f}\left\{g\,x(t),u(t),t+\left[\frac{\partial h}{\partial x}x(t),t\right]^T\dot{x}(t)+\frac{\partial h}{\partial t}x(t),t+p^T(t)f\,x(t),u(t),t-\dot{x}(t)\right\}dt. \tag{7}$$

For convenience, introduce the Hamiltonian function, $$H\,x(t),u(t),p(t),t\equiv g\,x(t),u(t),t+p^T(t)f\,x(t),u(t),t \tag{8}$$

It can be shown that in order for u(t) to minimize $J_a(u)$, and consequently J(u), $$\dot{x}(t)=\frac{\partial H}{\partial p}x(t),u(t),p(t),t, \tag{9}$$

$$\dot{p}(t)=-\frac{\partial H}{\partial x}x(t),u(t),p(t),t, \tag{10}$$

$$\frac{\partial H}{\partial u}x(t),u(t),p(t),t=\frac{\partial g}{\partial u}x(t),u(t),t+p(t)\frac{\partial f}{\partial u}x(t),u(t),t=0 \tag{11}$$

for all $t \in (0, t_f)$, $$p(t_f) = \frac{\partial h}{\partial x} x(t_f), t_f \tag{12}$$

$$x(0) = x_0 \tag{13}$$

The conditions of Eqs (9), (10), and (11) apply in general, and the conditions of Eqs (12) and (13) are necessary when the final states are free and the final time is fixed.

Because these conditions are only necessary, any input trajectory u(t) (e.g. strain-rate) that solves the problem under consideration will satisfy the conditions of Eqs (9) to (13). However, satisfaction of these necessary conditions alone does not necessarily guarantee an optimal trajectory.

An analytical solution to the microstructural trajectory optimization function defined above is difficult because of the complexity of the resulting functional forms. But an algorithm formulated according to these teachings can yield a numerical solution by satisfying all conditions but one and then iteratively bringing the remaining condition closer to satisfaction. This type of algorithm is based on the notion of the first variation of a functional, discussed in the following.

Given an initial estimate $u^{(0)}$ for the optimal control trajectory, calculate a change in u, $\Delta^{(0)}$, such that $u^{(0)}+\Delta u^{(0)}$ decreases the value of $J_a(u)$, i.e., $J_a(u^{(0)}+\Delta u^{(0)})<J_a(u^{(0)})$. Update u by $u^{(1)}=u^{(0)}+\Delta u^{(0)}$. Repeat this process until no further decrease in $J_a$ is obtainable.

If the conditions of Eqs (9), (10) and (12) are satisfied, the variation of $J_a$ is, $$\delta J_a = \int_0^{\tau} \frac{\partial H}{\partial u} \delta u dt \tag{14}$$

and one choice of $\delta u$ that will decrease $J_a$ is, $$\delta u = -\frac{\partial H}{\partial u}. \tag{15}$$

This $\delta u$ may be considered as the change in the time profile of u that decreases $J_a$ most rapidly. Because this is a first order variation only, the range over which it is accurate is limited and it is necessary to select a step length $\tau$ that limits the change in the time profile of u in the direction of $\delta u$ to ensure that $J_a$ $u+\Delta u<J_a(u)$, where, $\Delta u=\tau\delta u$.

Figure 3:
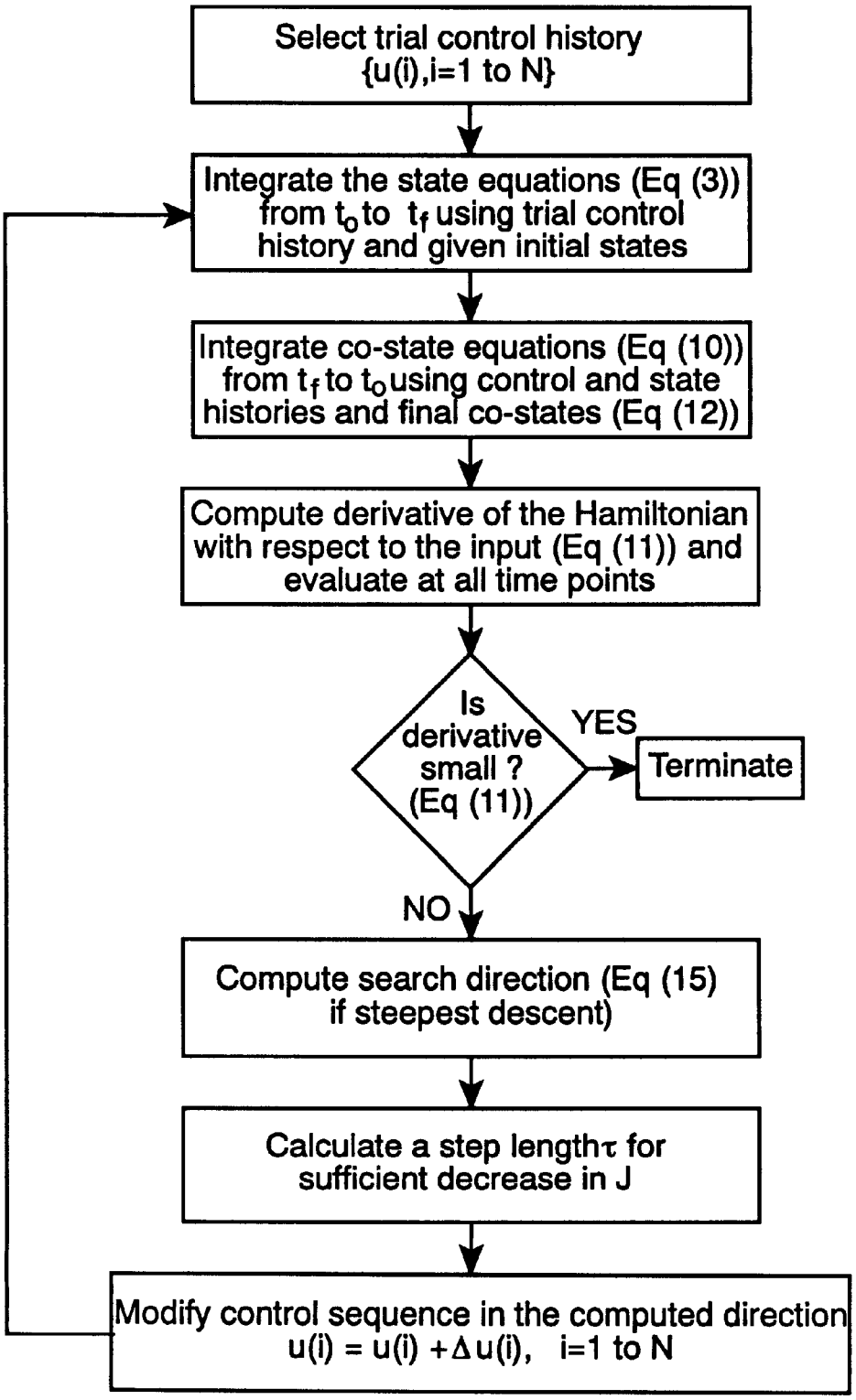
FIG. 3 is a flow chart for general step-length based descent algorithm of the invention.

Referring to FIG. 3, shown therein is a flow chart for a general step-length based descent algorithm of the invention. If Eq (15) is used as the direction in which the input history is modified, the algorithm is known as the steepest descent method, which converges globally at a linear rate. Other faster convergence methods may be used as discussed in the optimization literature.

Consider an example of controlling microstructure during hot extrusion of steel. Optimum ram velocity and die profile for extruding steel to obtain a prior austenitic grain size of 26 $\mu$m were determined using the two stage method of the invention. For this example, an empirical model formulated after Yada (see H. Yada, *Proc Int Symp Accelerated Cooling Of Rolled Steels, Conf Of Metallurgists,* CIM, Winnipeg MB Canada, August 24–26, eds G. E. Ruddle and A. F. Crawley, Pergamon Press, Canada, pp 105–20) to describe change in microstructure (grain size and volume fraction transformed) with time as a function of various process parameters (strain, strain-rate and temperature) in the dynamic recrystallization of AISI 1030 steel was used. Table II summarizes the model. The time derivative of the volume fraction recrystallized can be obtained by applying the chain rule of differentiation to the equation for $\chi$ in Table II to obtain the second equation in Table III. During mechanical working, fraction $\eta$ of the mechanical work is converted to heat and increases temperature of the material. Rate of temperature increase therefore depends on the rate of mechanical work $\sigma\dot{\epsilon}$ and the heat capacity $\rho C_p$ of the material. This results in the third equation of Table III. The expression for flow stress was obtained from experimental results given in the literature (see A. Kumar et al, "The Application of Constitutive Equations for Use in the Finite Element Analysis of Hot Rolling Steel", Unpublished Research, Steel Authority of India Ltd, New Delhi, India, and The Centre for Metallurgical Process Engineering, Univ of British Columbia, Vancouver BC Canada (1987). The evolution of strain is defined by the strain-rate, i.e., $u=\dot{\epsilon}$.

In the case of this example, the microstructural state of the material is therefore given by the state vector $x=\chi,T,\epsilon^T$, which transitions in time according to equations given in Table III Grain size is treated here as an output of the dynamical system and has not been included as one of the state variables since it does not directly affect the other state variables.

Figure 4A:
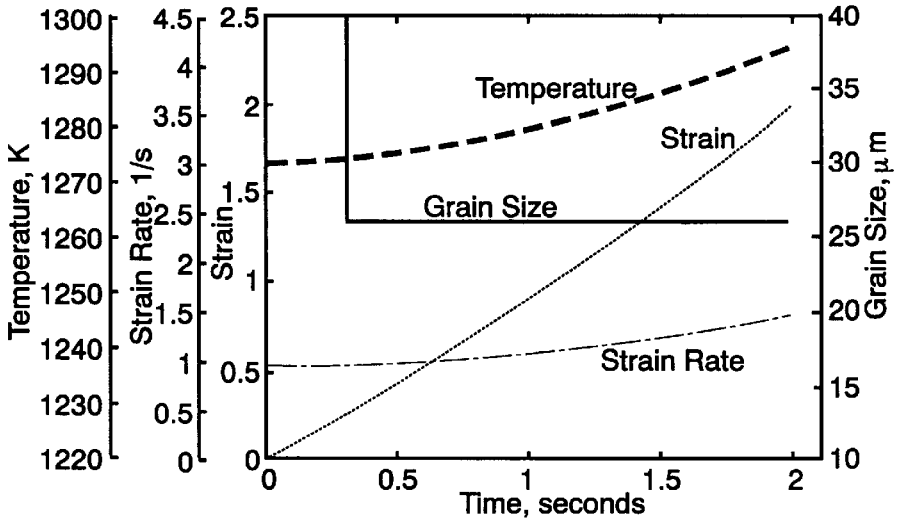
FIGS. 4*a,* 4*b* and 4*c* illustrate the trajectories of strain, strain rate, temperature and grain size for achieving desired respective final grain sizes of 26, 30 and 15 $\mu$m in samples of AISI 1030 steel.

Because microstructure directly influences mechanical properties of a material, the objective function for deformation processing should place emphasis on final mechanical and microstructural states of the material. It is also important that intermediate states of the material remain within certain regions of the state space to avoid catastrophic failure or other difficulty. In the present example, to attain a final strain of 2 and recrystallized grain size at 26 $\mu$m and using raw stock prior to extrusion having an average grain size of 180 $\mu$m, the objective function was chosen as, $$J = 10(\varepsilon(t_f) - 2.0)^2 + \int_0^{t_f} (d(t) - 26)^2 dt \tag{16}$$

with a weighting factor of 10 on the final strain term. The trajectory optimization algorithm of the invention was applied and the resulting optimal strain-rate, strain and temperature trajectories are shown in FIG. 4*a*. The Table II equations show that recrystallization does not begin until a critical strain $\epsilon_c$ has been imposed. The grain size trajectory is also shown in FIG. 4*a*. The initial grain size decreases to 26 $\mu$m at the critical strain of about 0.25. Grain size thereafter remains constant as a result of increasing temperature and strain rate. The required initial billet temperature was 1273° K.

All points in the deforming piece will not necessarily undergo the precise strain, strain-rate and temperature trajectories obtained in stage 11 of the invention, but deformation parameters such as die geometry, ram velocity and billet temperature can be selected to ensure that certain regions of the material will approximate the intended trajectories by using a second optimization procedure using a suitable method of thermomechanical analysis of the deformation process.

Figure 4B:
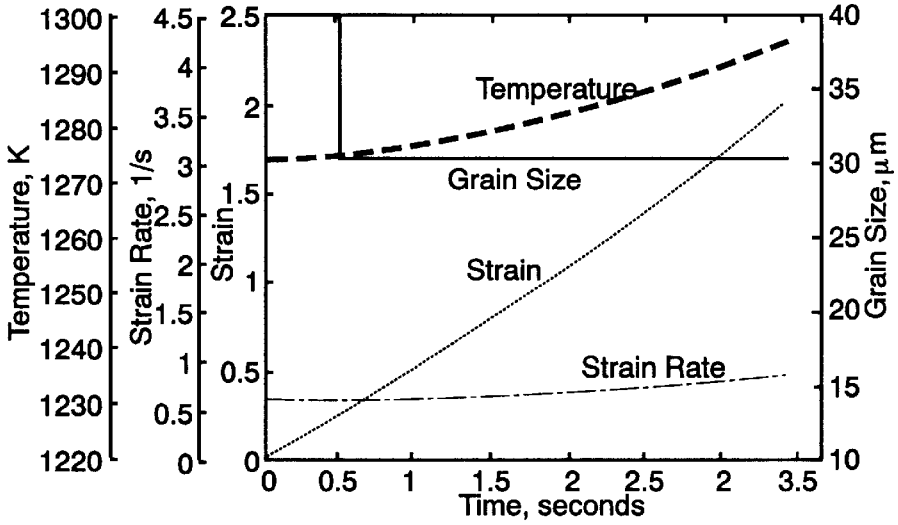
Figure 4C:
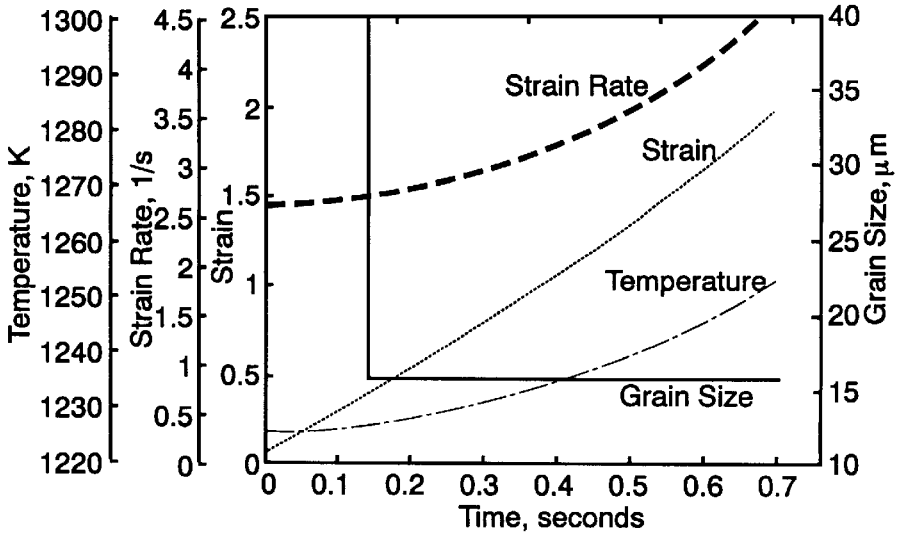
Figure 5:
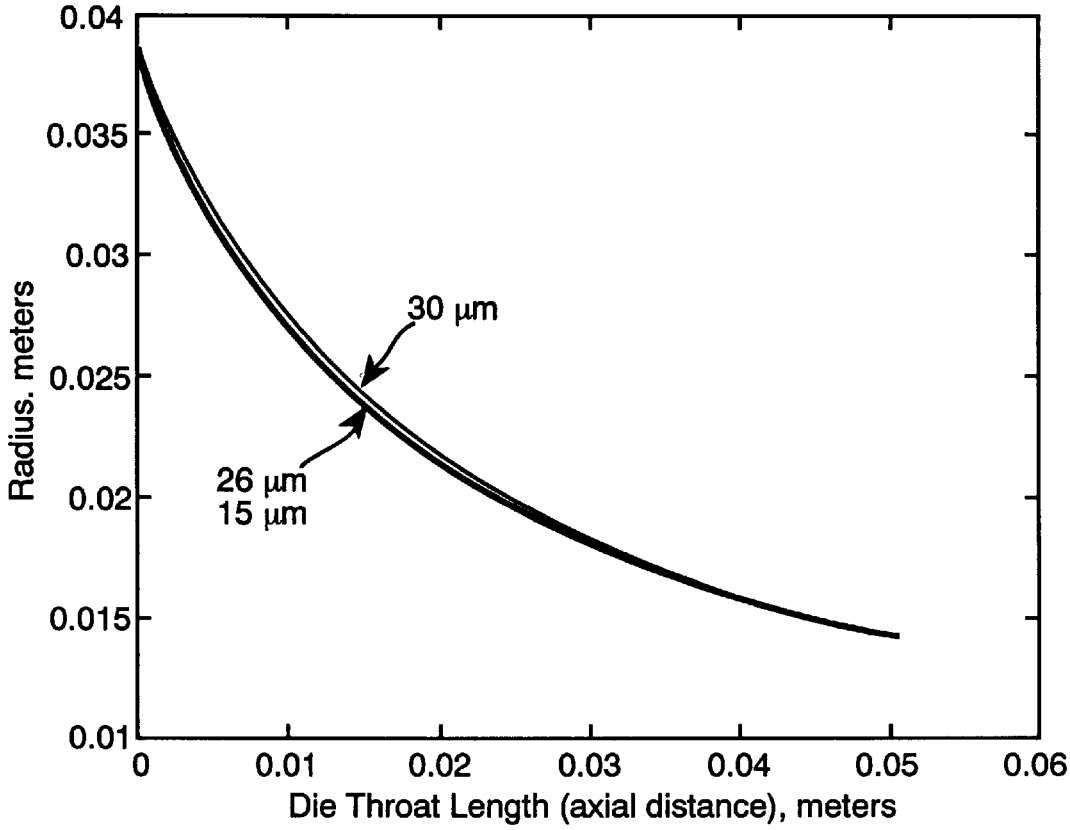
FIG. 5 shows the optimum die profile for achieving final grain sizes of 26, 30 and 15 $\mu$m in samples of AISI 1030 steel.

For ideal, round-to-round, frictionless extrusion, the die profile and ram velocity may be analytically predicted for the desired strain and strain-rate profiles along the workpiece centerline. If $r_0$ is the die entrance radius equal to the billet radius, L is the die length and the strain trajectory is given as a function $\epsilon(t)$, ram velocity is, $$V_{ram} = \frac{L}{\int_0^{t_f} \exp(\varepsilon(t))dt} \tag{17}$$

and the die profile is given by the sequence of ordered pairs {(y(t),r(t)}, where, $$r(t) = r_0 \exp(-\varepsilon(t)/2), \quad y(t) = V_{ram}\int_0^t \exp(\varepsilon(\tau))d\tau,$$

y is the die axial coordinate and r the die radius (see Medina et al, supra). The ram velocity was determined to be 8.43 mm/s and the die profile is shown in FIG. 5 (26 $\mu$m). FIGS. 4*b* and 4*c* present material trajectories for achieving grain sizes of 30 $\mu$m and 15 $\mu$m, respectively and FIG. 5 gives the corresponding optimal die profiles. Ram velocities were 5.0 mm/s (30 $\mu$m) and 25.1 mm/s (15 $\mu$m) and respective initial billet temperatures were 1273° K. and 1223° K. FIG. 5 shows that die profiles for the three cases are not significantly different. In this case, that grain size in a final product can be controlled by changing only initial billet temperature and/or ram velocity was demonstrated experimentally.

Figure 6:
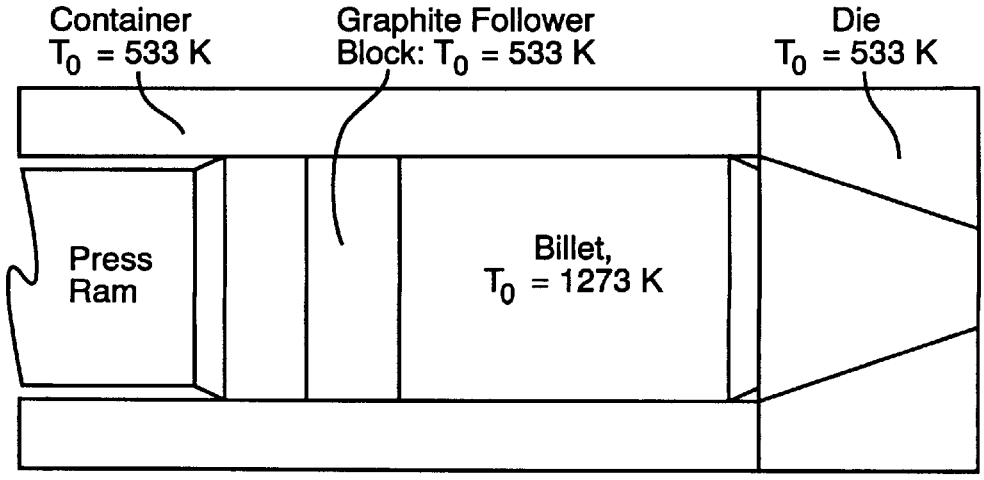
FIG. 6 shows a schematic of a billet, container, ram and die parts of an extrusion press useful in the practice of the invention.
Figure 7A:
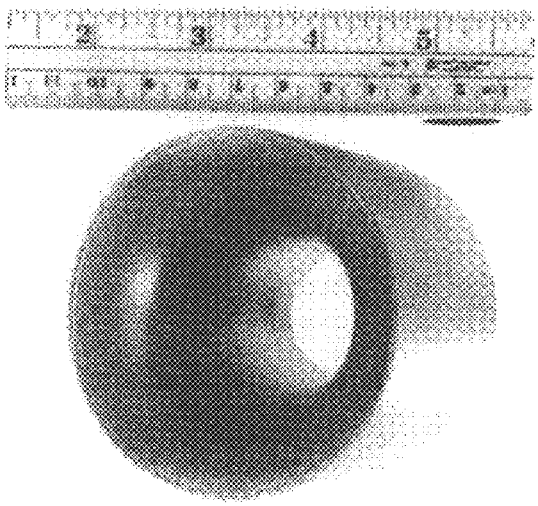
FIGS. 7*a,* 7*b* and 7*c* show photographs of, respectively, an extrusion die useful in the invention, a partially extruded piece and the extrudate.
Figure 7B:
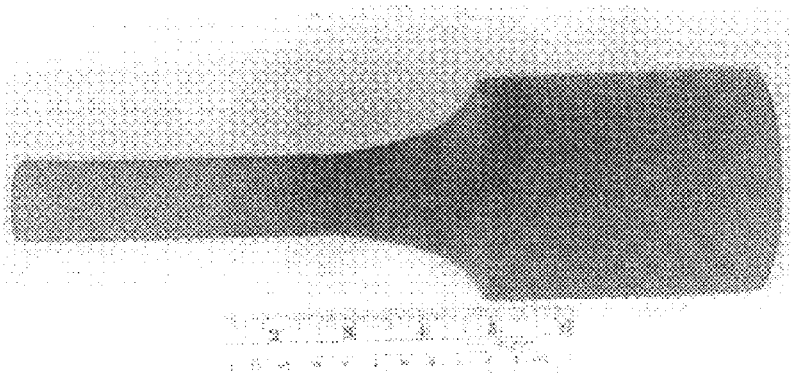
Figure 7C:
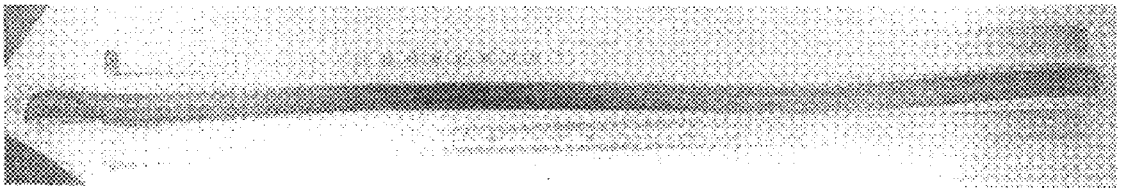
Figure 8A:
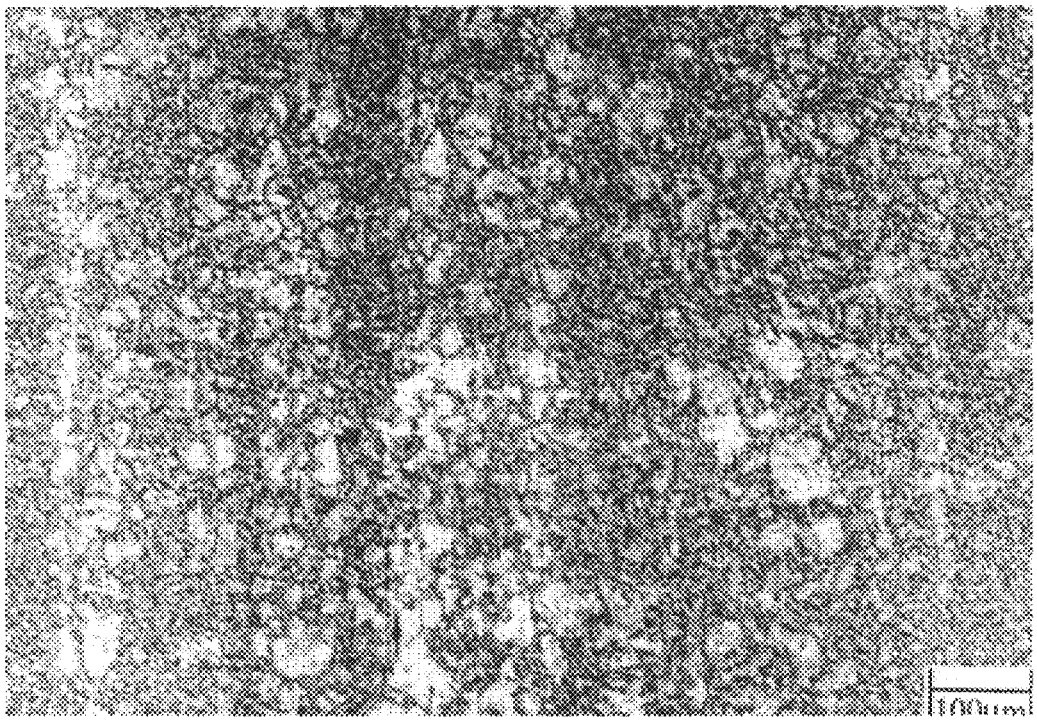
FIGS. 8*a* and 8*b* show typical microstructure, respectively, at the location of the leading end and at the trailing end of the FIG. 7*c* extrudate.
Figure 8B:
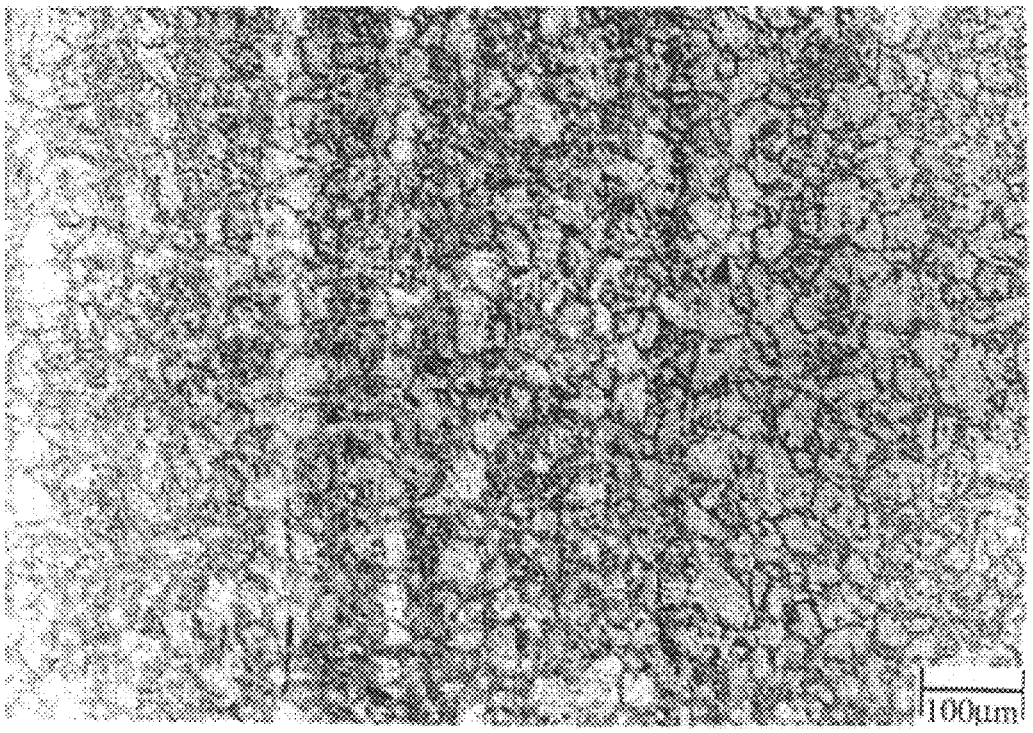

The invention was demonstrated using an extrusion process and finite element simulation with actual extrusions performed on a 6000 kN Lombard horizontal extrusion press. FIG. 6 shows the billet, container, ram and die parts of the press setup. An extrusion process for yielding 26 $\mu$m grain size in an extruded workpiece of AISI 1030 steel was formulated according to the invention. Specific process parameters included die geometry, area reduction, ram velocity and workpiece soak temperature. A die of prescribed shape with 7.6:1 reduction in area was fabricated as shown in FIG. 7*a* and a ram velocity of 8.43 mm/s was specified. Billet soak temperature was 1273° K. and die and follower block temperature was 533° K. Initial billet size was 74.15 mm diameter by 150 mm long. A first extrusion was allowed to proceed uninterrupted and the extrudate was water quenched within 5 seconds after extrusion. In order to study the evolution of the microstructure during deformation, a second extrusion was interrupted after a ram stroke of 75 mm, and the partially extruded billet was removed from the extrusion press and water quenched, which involved a 39 second delay between the end of deformation and the water quench. The prior austenite grain size variation along the workpiece centerline was measured at various sites along the length. The workpiece which underwent uninterrupted deformation exhibited 27 $\mu$m grain size over its entire length. Typical microstructures at the leading and trailing ends of the extrudate are shown in FIG. 8. Grain size for the interrupted extrusion was measured at various sites in the deformation zone.

Figure 9:
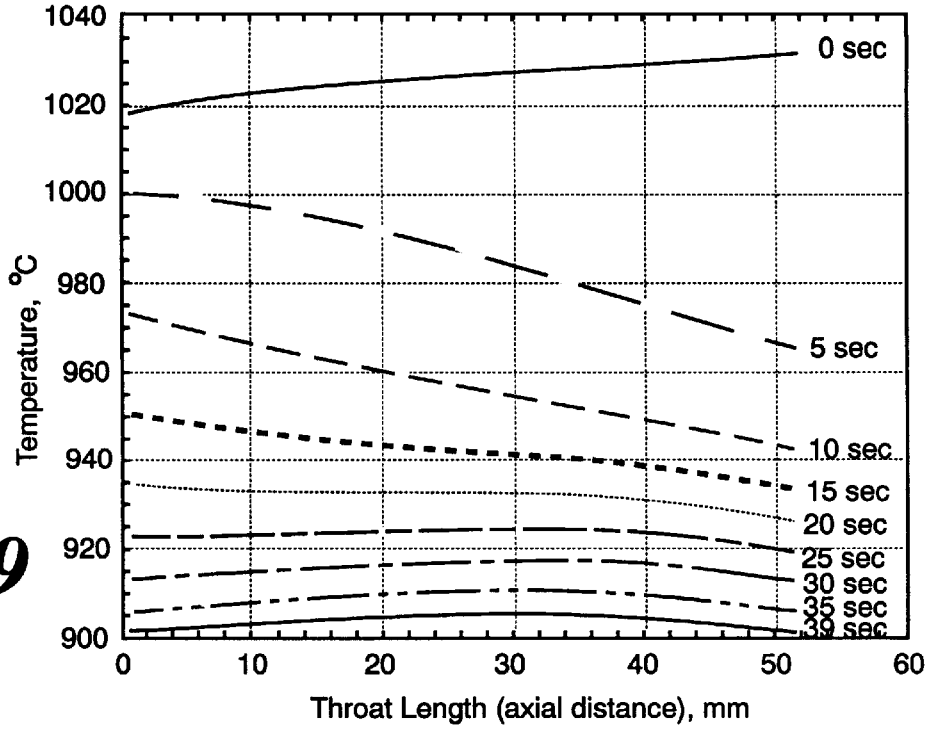
FIG. 9 shows the transient thermal history predicted by finite element simulation of the partially extruded billet during cooling after deformation and prior to water quench.
Figure 10:
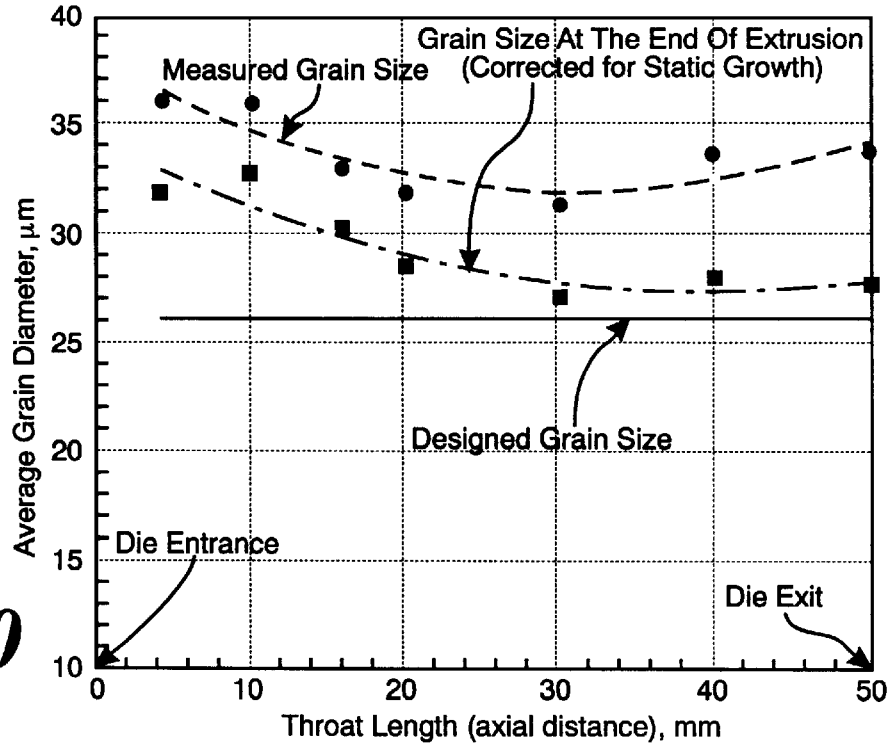
FIG. 10 shows the variation of measured and corrected grain size along the centerline of the partially extruded piece as a function of die throat length (axial distance)

The interrupted extrusion was simulated using a finite element based process simulation software (see UES, Inc., *Antares Software User Manual* (1995)). The step size for simulation was about 1/100 of the total ram stroke. The process was simulated for the nonlinear coupled response of the billet and the thermal response of the die. After the partial extrusion, the temperature at the billet centerline increased to 1313° K. because of deformation heating. Accumulated strain at the billet centerline was 2.0. Air cooling of the partially extruded billet for 39 seconds prior to water quench was then simulated. FIG. 9 shows the variation in temperature with time during cooling. During the cooling period, the austenitic microstructure experienced static grain growth which may be approximated by the following model (see H. Yada, supra).

$$d^2 = d_0^2 + At\exp\left(\frac{-Q_{gg}}{RT}\right) \tag{18}$$

where $d_0$ and d are the recrystallized grain size upon extrusion and the statically grown grain size, respectively, t is elapsed time in seconds between completion of extrusion and quenching, A is $1.44\times10^{12}$ $(\mu m)^2 s^{-1}$, Q is the activation energy for static grain growth, R is the gas constant, and $Q_{gg}/R$ is 32100K at the extrusion temperature of 1273° K. The predicted temperature changes during cooling were used to estimate grain size increase resulting from static grain growth during the 39-second cooldown. FIG. 10 shows the variation of measured and corrected grain size along the centerline of the partially extruded piece as a function of axial distance along the die length, including measured grain size, prior austenite grain size corrected for static grain growth and design grain size. The corrected grain size is about 27.5 $\mu$m beyond an axial position of 20 mm.

Figure 11:
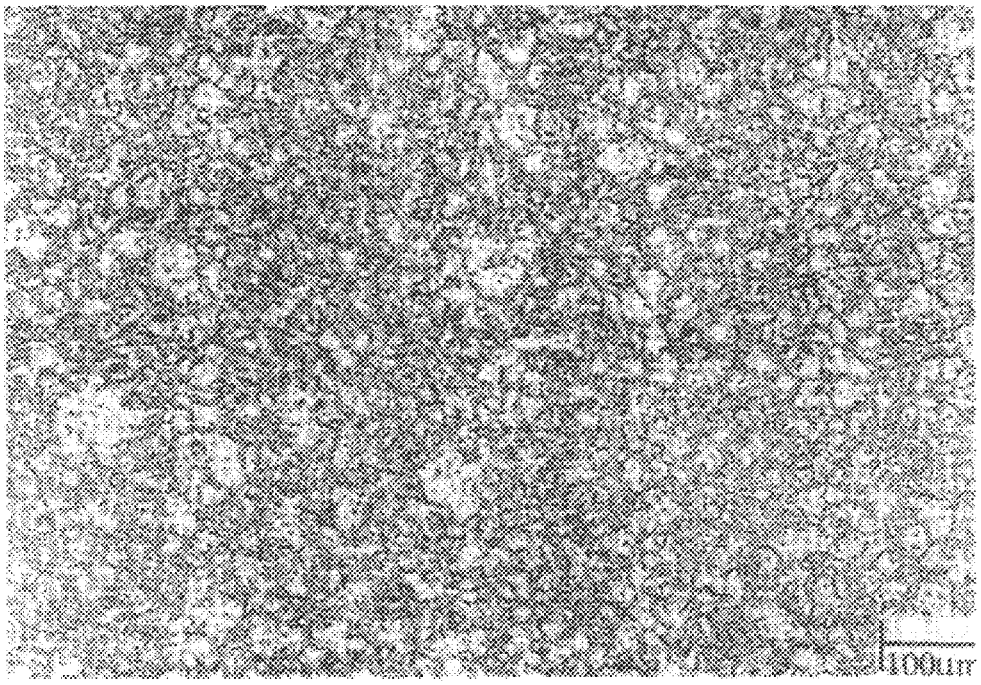
FIG. 11 shows typical microstructure of AISI 1030 steel resulting from extrusion process parameters of the invention yielding a measured grain size of 17 $\mu$m.
Figure 12A:
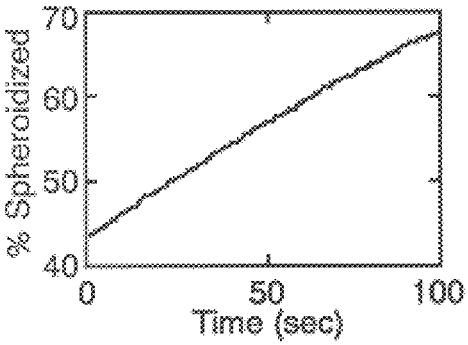
FIG. 12 shows evolution of, respectively, percent spherodization, temperature, strain and grain size in the development of a titanium aluminide alloy (Ti-49Al-2Mo atomic percent (at %)) lamellar microstructure.
Figure 12B:
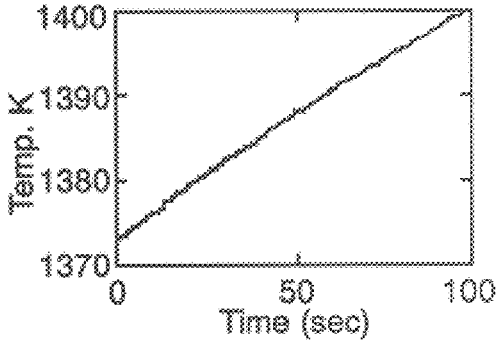
Figure 12C:
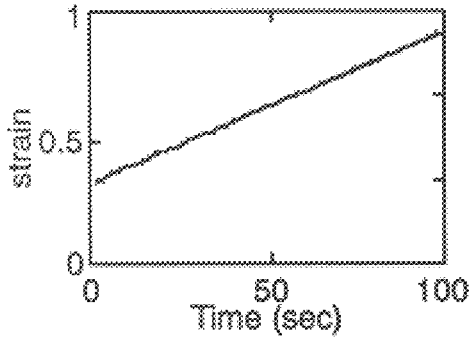
Figure 12D:
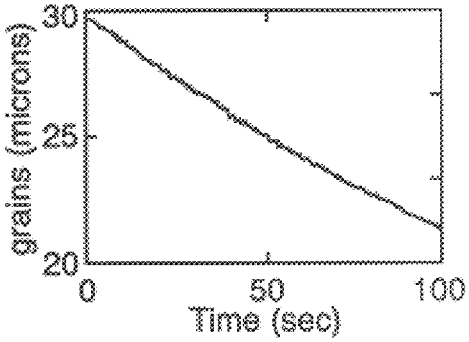

Extrusions according to the invention were also performed on the Lombard press to yield a 15 $\mu$m grain size in an extruded workpiece of AISI 1030 steel using the same process parameters and die profile used for producing the 26 $\mu$m grain size extrusion. Ram velocity was 25.1 mm/s, billet soak temperature was 1223° K. and the extruded rod was water quenched immediately after extrusion. Microstructural examination on the extrudate showed uniform microstructure throughout the approximate two-meter rod length. Typical microstructure is given in FIG. 11. Measured average grain size was 17 $\mu$m.

The method of the invention was also applied to control microstructure during manufacture of a gamma-titanium aluminide sub-scale integral blade and rotor component (IBR). Manufacture of the IBR consisted of two forming steps: (1) a billet upsetting to alter the microstructure followed by (2) a closed die forging with the primary purpose of altering shape. The material used in the demonstration was Ti-49Al-2Mo (at %) with a nearly fully lamellar, two-phase microstructure. A primary mechanism of microstructure refinement in this material is dynamic spheriodization. The microstructural models (ref S. Guillard, *High Temperature Micro-Morphological Stability Of The* ($\alpha_2+\gamma$) *Lamellar Structure In Titanium Aluminides,* PhD Thesis, Clemson Univ (1994)) obtained from hot compression tests were used for optimization and control of microstructure in the forged product. Equations relating strain $\epsilon$, strain rate $\dot{\epsilon}(t)$ (inch/sec) and temperature T in Celsius, with volume fraction spheriodized $\chi$ and spheriodized grain size d are as follows:

$$\chi = 2061.38 + 7.0171\log\dot{\epsilon} - 3.7908T + 56.84\epsilon + 0.001776T^2 - 12.52\epsilon^2 \tag{19}$$

$$d = 248.22 + 142.97\log\dot{\epsilon} - 0.1284T - 59.32\epsilon + 8.77(\log\dot{\epsilon})^2 + 7\epsilon^2 - 0.0833T\log\dot{\epsilon} - 15.833\epsilon\log\dot{\epsilon} \tag{20}$$

These equations are valid for:

$$0.35 \leqq \epsilon \leqq 2.03 \quad 10^{-4} \leqq \dot{\epsilon} \leqq 10^{-2} \quad 1331 \leqq T \leqq 1415°\ \text{K.}$$

To determine the necessary state-variable equations, the evolution equations, Eqs (19) and (20), were differentiated to obtain the following dynamic equations for the microstructural evolution.

$$\dot{\chi} = (56.84 - 25.04\epsilon)\dot{\epsilon} \tag{21}$$

$$\dot{d} = (-59.82 + 14\epsilon - 15.833\log\dot{\epsilon})\dot{\epsilon} \tag{22}$$

The dynamical equation for temperature rise is given by, $$\dot{T} = \frac{\eta}{\rho C_p}\dot{\varepsilon}\sigma(\varepsilon, \dot{\varepsilon}, T) \tag{23}$$

where η is an efficiency factor (usually equal to 1/(1+m), m is well known strain-rate sensitivity parameter), ρ is density, $C_p$ is the specific heat and σ is the flow stress, each of which is material dependent. The flow stress was assumed to have the form, $$\sigma = e^{p(\epsilon, \dot{\epsilon}, T)} \tag{24}$$

where p is a cubic polynomial in strain, strain rate and temperature.

The simplest cost functional form for achieving desired final states is a quadratic form, $$J = w_1(\chi(t_f) - \chi_{des})^2 + w_2(d(t_f) - d_{des})^2 + w_3(\epsilon(t_f) - \epsilon_{des})^2 + w_4(T(t_f) - T_{des})^2 \tag{25}$$

where $w_i$ are the weights that were used to place different emphasis on each state depending on the relative importance of the final value of each state, $t_f$ is the time for the completion of the process and the subscript des denotes the desired values.

The design objective given in Eq (25) was used to achieve a final strain level of 0.9, to limit the maximum deformation temperature to 1390° K., and to transform 70 volume percent (vol %) of the TiAl lamellar microstructure with a spheriodized grain size of 20 μm. An initial deformation temperature of 1373° K. was chosen based on hot workability considerations and the strain-rate was kept below $10^{-2}$ $s^{-1}$ to avoid fracture problems. Values selected for the weight factors ($w_1=10^{-2}$, $w_2=10^{-4}$, $w_3=10^2$, $w_4=10^{-2}$) placed emphasis on achieving the final strain value. A microstructure trajectory optimization algorithm as described in the invention was applied, and the resulting time evolution predictions of vol % spheriodized, deformation temperature, strain and grain size are presented in FIG. 12. These results indicate that all design objectives could be met. The optimized values at the final time were 0.9 strain, 1400° K. maximum deformation temperature, 68 vol % of the TiAl lamellar microstructure with a spheriodized grain size of 21 μm. The corresponding strain-rate profile for optimal process control was constant at $5.6\times10^{-3}$ $s^{-1}$ for the duration of 100 seconds.

Figure 13:
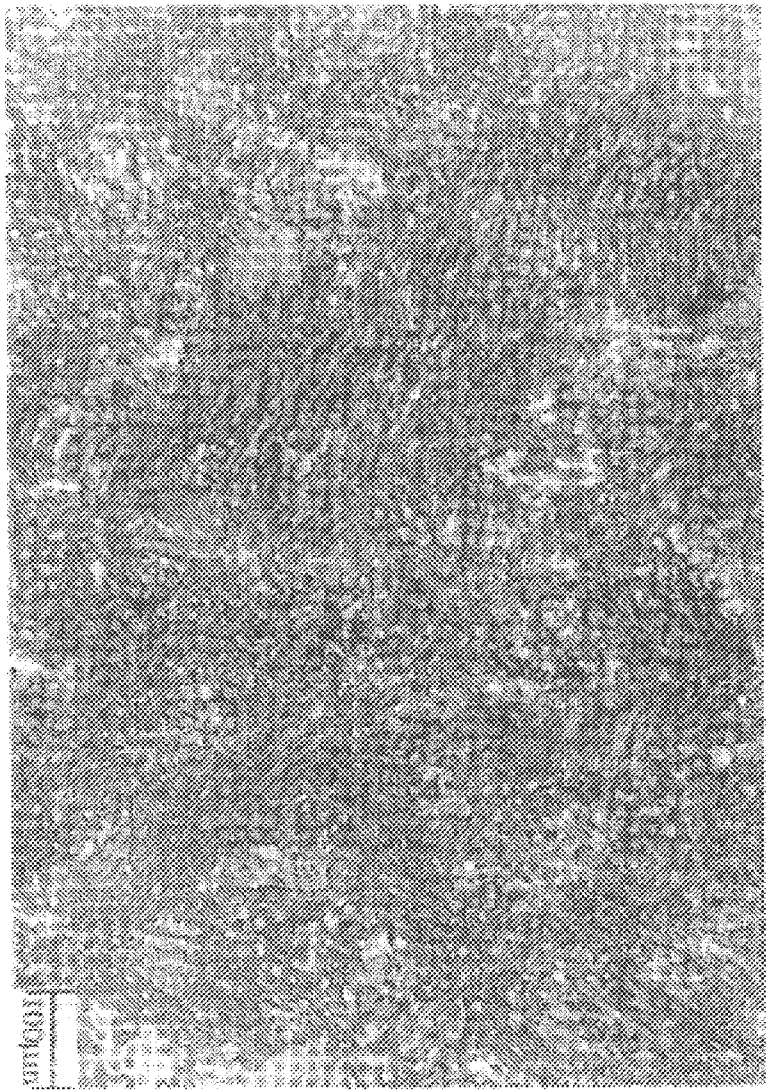
FIG. 13 shows typical spheriodized lamellar microstructure of Ti-49Al-2V after upset forge according to optimal conditions selected according to the method of the invention.

Forging experiments were conducted to verify the computed optimal process conditions for spheriodization of a near fully lamellar TiAl microstructure. Cast hot isostatically pressed billets of Ti-49Al-2V were upset forged at close approximations to the optimal temperature, strain and strain-rate conditions of FIG. 12. Minor compromises in the ideal test conditions were required because of practical limitations of the forging equipment, such as a two-step ram velocity profile in lieu of a continuous variation mode. Initial billet geometry was 5.5 inches diameter by 7.5 inches in high. The upset forge was near isothermal with an initial temperature of 1373° K. The billet was upset to a strain level of 0.9 with approximately constant strain rate of $5.0\times10^{-3}$ $s^{-1}$. FIG. 13 shows typical microstructure of the forged billet. The measured volume fraction spheriodized in the forged billet was 70% which validates the microstructure trajectory optimization algorithm of the invention.

Figure 14:
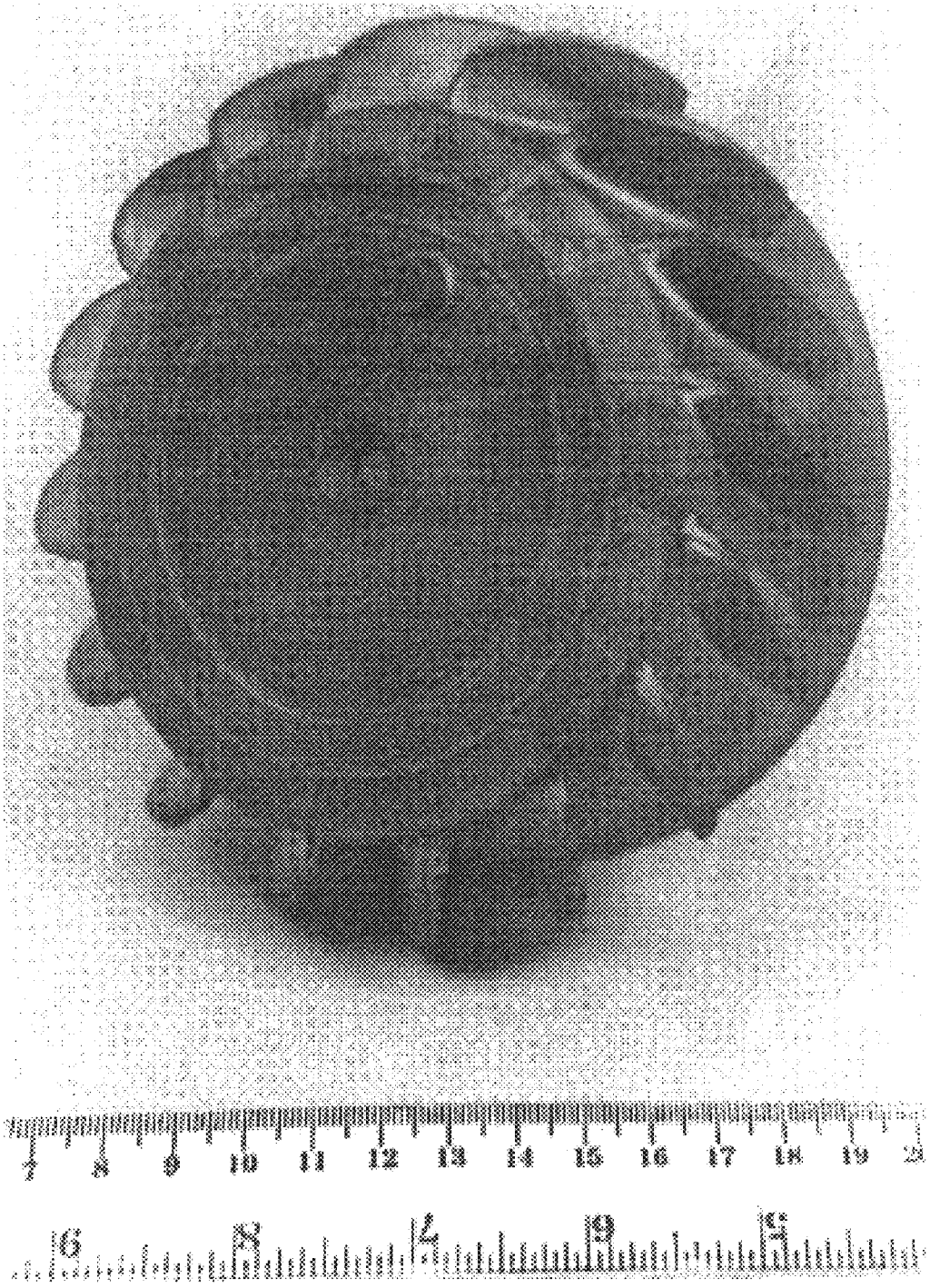
FIG. 14 shows a subscale rotor-like forging of Ti-49Al-2V preform prepared in the practice of the method of the invention.
Figure 15:
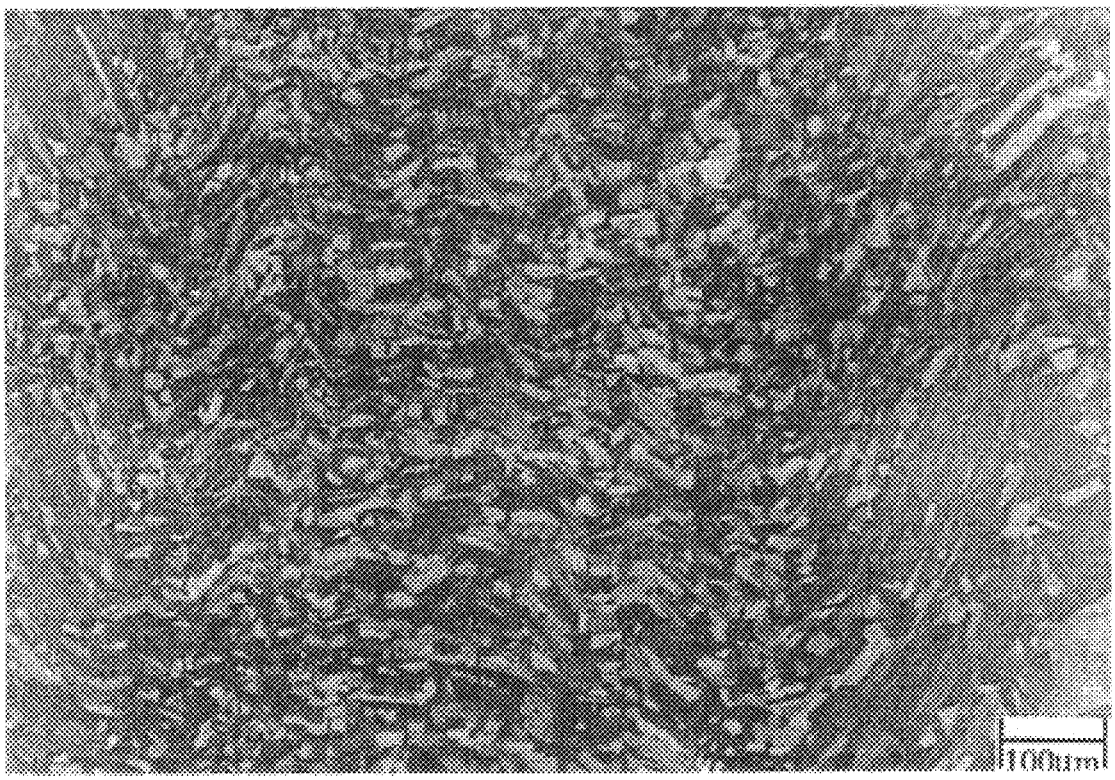
FIG. 15 shows typical microstructure in the FIG. 14 forging.

Subsequently, the upset forged material was machined to a certain preform shape and heat treated at 1403° K. to homogenize the microstructure. The preform was then isothermally forged using a segmented tooling package for making subscale bladed rotor-like components. Blades were successfully formed to a length of about 0.625 inches without cracking as shown in FIG. 14. The spheriodized, fine grain microstructure throughout the preform provided enhanced workability and metal flow without fracture in subsequent closed die forging. A typical final microstructure from the subscale bladed rotor-like forging is shown in FIG. 15.

The entire teachings of all references cited herein are incorporated herein by reference.

The invention therefore provides a method for selecting process parameters in the design, optimization and control of microstructure in metals and alloys during hot working fabrication processes. It is understood that modifications to the invention may be made as might occur to one with skill in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

TABLE I

| Design Objective | Term in the Optimality Criterion |
|---|---|
| Achieve final average grain size $x_d$ | $J_i^F = \beta_i\, x(t_f) - x_d^2$ |
| Achieve final strain of $\epsilon_1$ | $J_i^F = \beta_i\, \epsilon(t_f) - \epsilon_1^2$ |
| Maintain strain-rate between $u_1$ and $u_2$ because of workability considerations | $J_j^T = \int_0^{t_f} \beta_j(t) f\, u, u_1, u_2\, dt$ |
| Limit deformation heating; initial temperature is $T_0$ | $J_j^T = \int_0^{t_f} \beta_j(t) T - T_0^2\, dt$ |
| Keep strain-rate under $u_1$ because of equipment limitations | $J_j^T = \int_0^{t_f} \beta_j(t) f\, u, u_1\, dt$ |
| Maintain temperature between $T_1$ and $T_2$ because of workability considerations | $J_j^T = \int_0^{t_f} \beta_j(t) f\, T, T_1, T_2\, dt$ |
| Limit energy consumption; $u^2(t)$ is a measure of power | $J_j^T = \int_0^{t_f} \beta_j(t) u^2(t)\, dt$ |

TABLE II

| | |
|---|---|
| Volume fraction recrystallized | $\chi = 1 - \exp \ln(2)\, (\epsilon - \epsilon_c)/\epsilon_{0.5}^2$ |
| Critical strain | $\epsilon_c = 4.76 \times 10^{-4} e^{8000/T}$ |
| Plastic strain for 50% volume fraction recrystallization | $\epsilon_{0.5} = 1.144 \times 10^{-3}\, d_0^{0.28}\, \dot{\epsilon}^{0.05}\, e^{6420/T}$ |
| Average recrystallized grain size | $d = 22600\, \dot{\varepsilon}^{-0.27} e^{-0.27\left(\frac{Q}{RT}\right)}$ |
| Activation energy & gas constant | Q = 267 kJ/mol, R = $8.314 \times 10^{-3}$ kJ/mol − K |

TABLE III

| | |
|---|---|
| Time derivative of volume fraction recrystallized | $\dot{\chi} = \frac{\partial \chi}{\partial \varepsilon}\frac{\partial \varepsilon}{\partial t} = \frac{2 \ln 2}{(\varepsilon_{0.5})^2}(\varepsilon - \varepsilon_c)(1 - \chi)\dot{\varepsilon}$ |
| Time derivative of temperature | $\dot{T} = \frac{\eta}{\rho C_p}\sigma(\varepsilon, \dot{\varepsilon}, T)\dot{\varepsilon}$ |

TABLE III-continued

| | |
|---|---|
| Flow stress (kPa) | $\sigma = \sinh^{-1} \dot{\epsilon}/A^{1/n}\, e^{Q/nRT}/0.0115 \times 10^{-3}$ |
| | $\ln A(\epsilon) = 13.92 + 9.023/\epsilon^{0.502}$ |
| | $n(\epsilon) = -0.97 + 3.787/\epsilon^{0.368}$ |
| Activation energy & gas constant | $Q(\epsilon) = 125 + 133.3/\epsilon^{0.393}$, $R = 8.314 \times 10^{-3}$ |

We claim:

1. A method for fabricating an article from a metallic material, comprising the steps of:

(a) providing a billet of metallic material for fabricating an article;

(b) selecting a prescribed final microstructure and grain size in said material comprising the fabricated article;

(c) generating data defining material trajectories for true plastic strain, strain rate and temperature versus time on samples of said material within predetermined ranges of temperature and strain rate to achieve said final microstructure and grain size in said material;

(d) selecting from said data the optimal material trajectories for achieving said prescribed final microstructure and grain size in said material;

(e) determining the optimal initial conditions for hot forming said billet to achieve said prescribed microstructure and grain size in said material;

(f) selecting optimal hot forming process parameters corresponding to said optimal material trajectories and said optimal initial conditions for achieving said prescribed final microstructure and grain size; and (g) hot forming said billet of material along said optimal material trajectories using said optimal hot forming process parameters to a predetermined shape for said article.

2. The method of claim 1 wherein said hot forming process includes the step of providing an extrusion die and the step of hot forming said billet includes the step of extruding said billet through said die.

3. The method of claim 1 further comprising preheating said billet prior to hot forming.

4. The method of claim 3 wherein said billet is preheated to a temperature of about 1223 to 1373° K.

5. A method for fabricating an article from a metallic material, comprising the steps of:

(a) providing a billet of metallic material for fabricating an article;

(b) selecting a prescribed final microstructure and grain size in said material comprising the fabricated article;

(c) generating data defining material trajectories for true plastic strain, strain rate and temperature versus time on samples of said material within predetermined ranges of temperature and strain rate to achieve said final microstructure and grain size in said material;

(d) selecting from said data the optimal material trajectories for achieving said prescribed final microstructure and grain size in said material;

(e) determining the optimal initial conditions for hot forming said billet to achieve said prescribed microstructure and grain size in said material;

(f) selecting optimal strain rate and extrusion temperature and die profile corresponding to said optimal material trajectories and said optimal initial conditions for achieving said prescribed final microstructure and grain size in said fabricated article;

(g) preheating said billet to a temperature of about 1223 to 1373° K. and;

(h) extruding said billet of material along said optimal material trajectories using said optimal hot forming process parameters to a predetermined shape for said article.

6. In a method for hot forming a metallic material, an improvement wherein optimum processing parameters are preselected for performing said hot forming, said improvement comprising the steps of:

(a) generating data defining material trajectories for true plastic strain, strain rate and temperature versus time on samples of a metallic material within predetermined ranges of temperature and strain rate;

(b) selecting from said data the optimal material trajectories for achieving a prescribed final microstructure and grain size in said material;

(c) determining the optimal initial conditions for hot forming said billet to achieve said prescribed microstructure and grain size in said material; and (d) selecting optimal hot forming process parameters corresponding to said optimal material trajectories and said optimal initial conditions for achieving said prescribed final microstructure and grain size.

* * * * *